United States Patent [19]

Boyd et al.

[11] 4,423,832

[45] Jan. 3, 1984

[54] INFLATABLE LINER FOR PARTICULATE BULK CARGO RECEPTACLES

[75] Inventors: Hugh Boyd, Tallmadge, Ohio; John J. Kane, Erie, Pa.

[73] Assignee: Goodyear Aerospace Corporation, Akron, Ohio

[21] Appl. No.: 288,080

[22] Filed: Jul. 29, 1981

[51] Int. Cl.[3] ..... B65G 69/08

[52] U.S. Cl. ..... 222/203

[58] Field of Search ..... 222/195, 196, 200, 202, 222/203, 386.5, 198, 206, 460; 414/288; 244/134 A

[56] References Cited

U.S. PATENT DOCUMENTS

| | | | |
|---|---|---|---|
| 2,536,739 | 1/1951 | Greene | 244/134 A |
| 2,646,905 | 7/1953 | Vincent | 222/203 X |
| 3,525,445 | 8/1970 | Barger | 222/203 X |
| 4,359,172 | 11/1982 | Kane | 222/203 X |
| 4,373,645 | 2/1983 | Boyd | 222/203 |

FOREIGN PATENT DOCUMENTS

| | | | |
|---|---|---|---|
| 2062630 | 6/1972 | Fed. Rep. of Germany | 222/203 |
| 1336861 | 11/1973 | United Kingdom | 222/203 |

*Primary Examiner*—Joseph J. Rolla
*Assistant Examiner*—Kevin P. Shaver
*Attorney, Agent, or Firm*—P. E. Milliken; L. A. Germain

[57] ABSTRACT

An inflatable liner for mounting within a hopper type receptacle or container which receives and discharges flowable bulk particulate material. The liner is comprised of one or more inflatable members such as inflatable fabric bags or tubular members loosely supported by sling members at spaced locations along the interior surface of the walls of the container in such manner that each inflatable member is capable of limited miltidirectional movement with respect to the adjacent container wall and a flexible wear resistant cover sheet loosely covering the wall and the inflatable members. The slings may be attached to either the container wall or to the bottom side of the cover sheet. Alternate inflatable members are inflated and deflated in any desired sequence to cause the cover sheet to undulate and thereby set up a continuous cyclic wave motion which serves to maintain the continuous flow of particulate material through the container.

7 Claims, 6 Drawing Figures

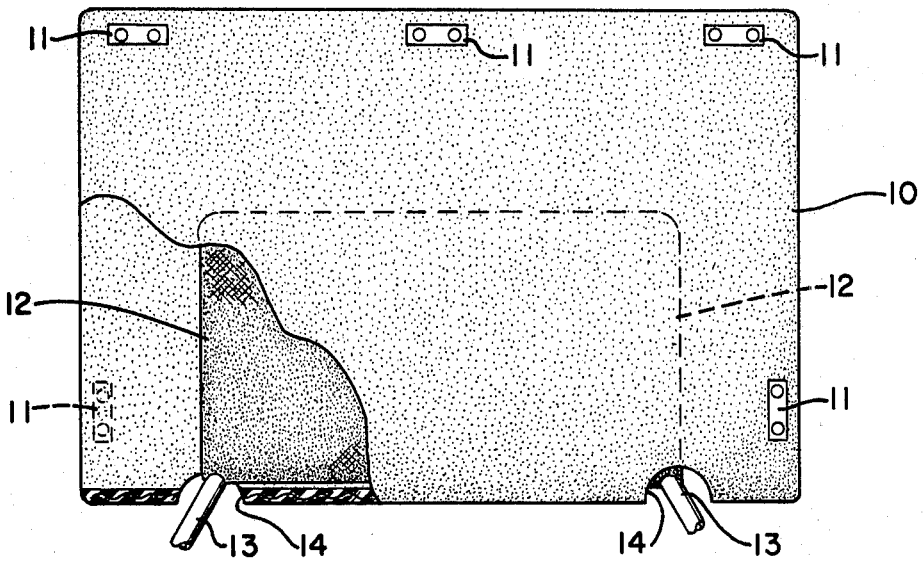
FIG.-3
FIG.-4
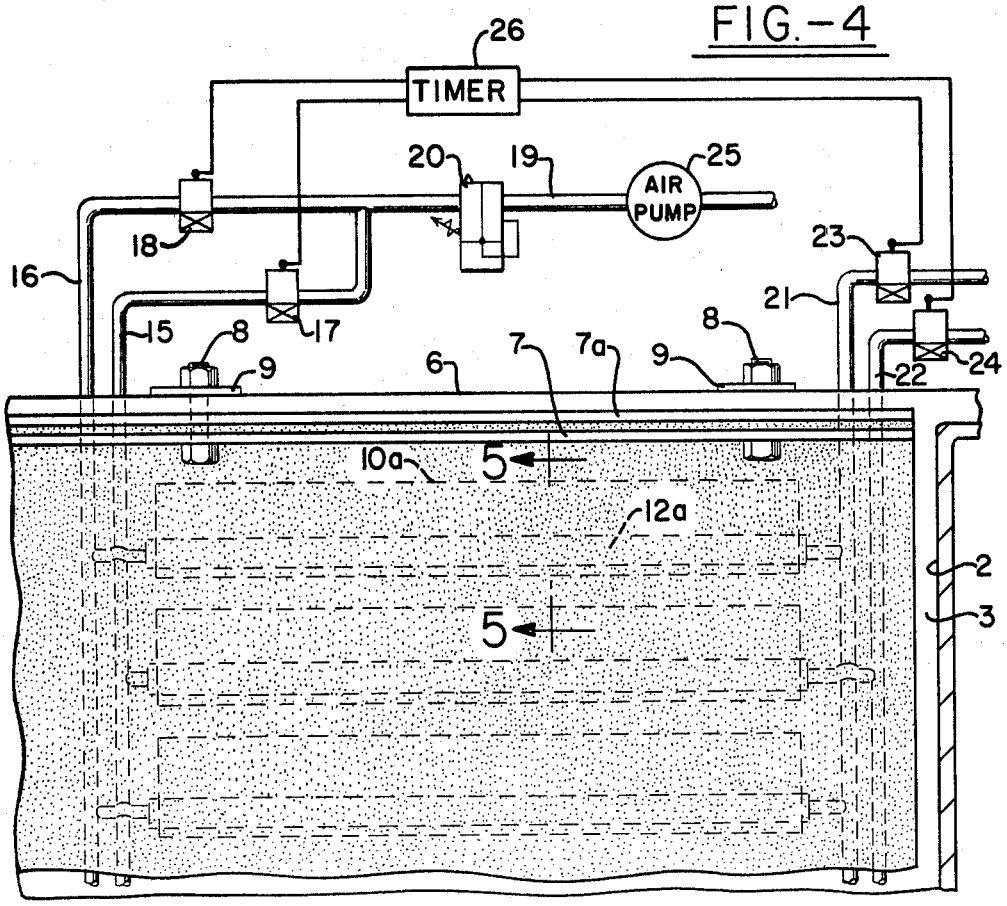

INFLATABLE LINER FOR PARTICULATE BULK CARGO RECEPTACLES

This invention relates to inflatable liner for mounting within a hopper type receptacle which receives and discharges flowable bulk particulate material.

BACKGROUND OF THE INVENTION

In the past many devices have been used within hopper type containers to maintain a continuous flow of particulates through the container. Such devices are often needed when materials such as coal, ore, sand and other particulate materials tend to rathole or become impacted within the container particularly when they are of certain external shapes or surfaces or are mixed with water or a bonding agent or exposed to freezing temperature.

Some of the hoppers have been equipped with vibrators for shaking the container or its walls to dislodge the particulate matter and induce a flow through the container. In some instances, jets of high pressure air have been introduced into the material to start and maintain its continuous flow through the receptacle.

In addition to these techniques, various types of inflatable bags have been placed on the inner walls of the containers and alternately inflated and deflated to create a varying pressure against the particulate matter and break such jams or icing of the material. A typical example of such device is shown in U.S. Pat. No. 2,646,905 issued to W. R. Vincent. Such device operates somewhat on the principle of the inflatable deicers used on aircraft wings, such as that on U.S. Pat. No. 2,536,739 issued to H. E. Greene. The above mentioned Vincent patent appears to be one of the closest prior art patents known to the inventor of the invention described in this specification.

SUMMARY OF THE INVENTION

The present invention is designed to maintain a continuous flow of particulate material through a container by alternately inflating and deflating various individual chambers or compartments of an inflatable liner assembly. According to this invention, the inflatable liner assembly is mounted on the interior surface of the wall of a hopper type receptacle which receives and discharges flowable bulk particulate material. The receptacle has conical or sloping walls in at least the bottom portion and the liner comprises:

a plurality of inflatable members at spaced locations along said interior surface, a flexible cover sheet covering said members and said surface, the cover sheet being attached along its upper edge to the container to suspend it within the container, and means loosely supporting the inflatable members to permit limited multidirectional movement with respect to the cover sheet and the adjacent container wall when the members are alternately inflated and deflated.

BRIEF DESCRIPTION OF THE DRAWINGS

FIG. 3 is an enlarged view of one embodiment of the invention showing a typical inflatable bag being supported inside a fabric sling member;

FIG. 4 is a diagramatic partial elevational view showing another embodiment of the invention;

DESCRIPTION OF THE PREFERRED EMBODIMENT

Figure 1:
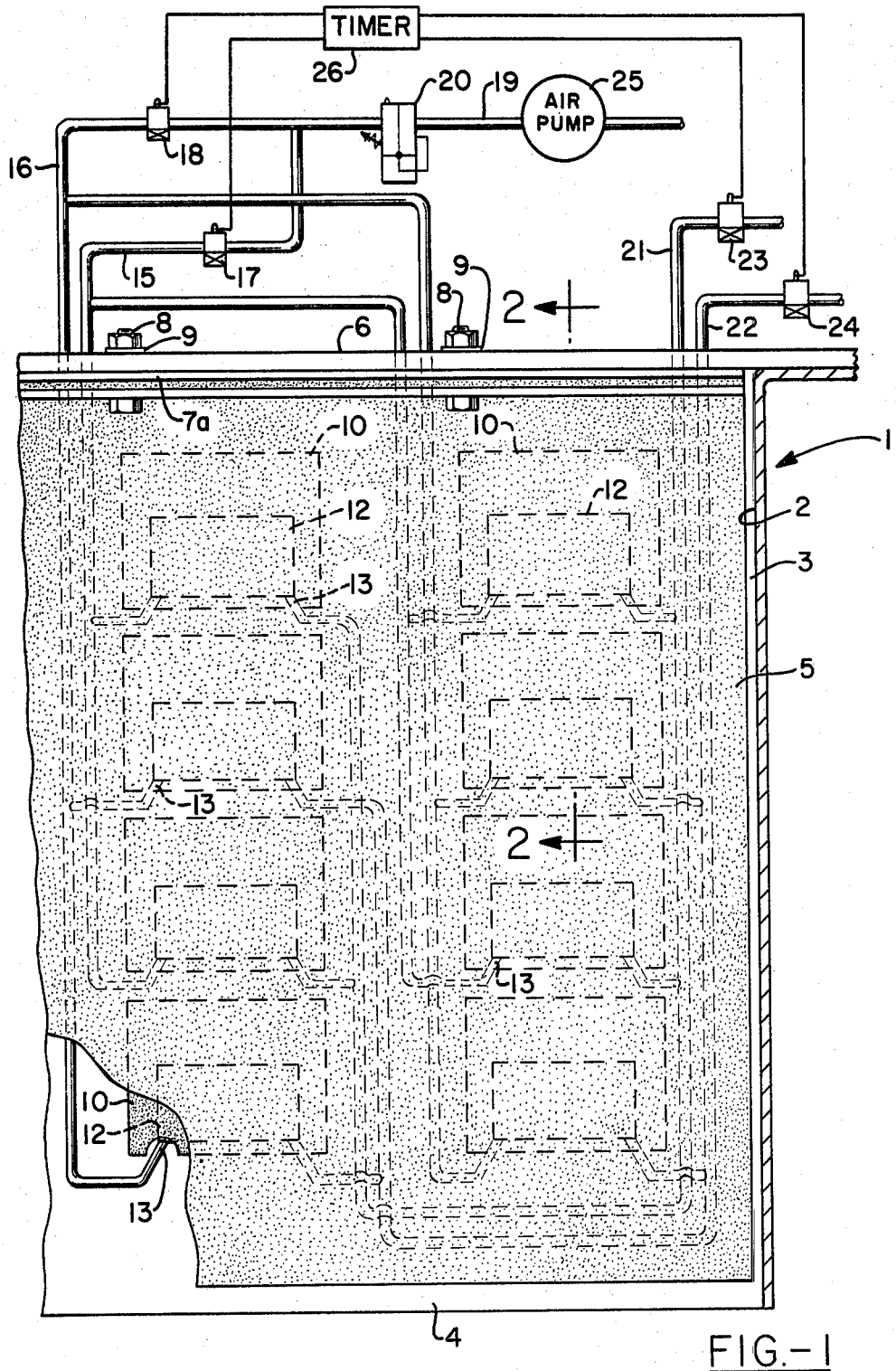
FIG. 1 is a diagramatic elevational view showing one embodiment of the invention as mounted on the interior wall of a container.
Figures 2, 5, 6:
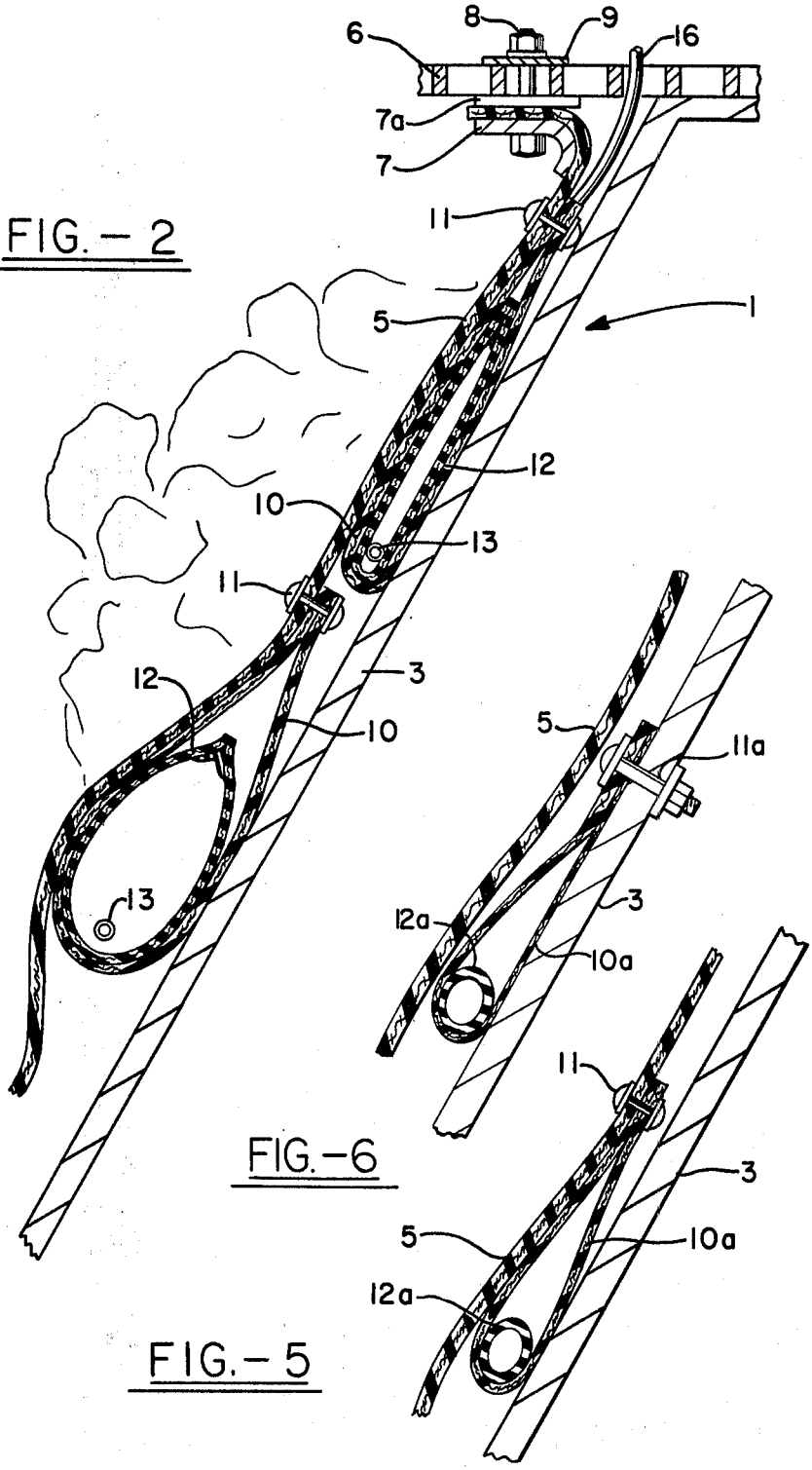
FIG. 2 is an enlarged fragmentary cross-sectional view taken on Line 2—2 of FIG. 1.
FIG. 5 is an enlarged fragmentary cross-sectional view taken on Line 5—5 of FIG. 4.
FIG. 6 is an enlarged fragmentary cross-sectional view similar to FIG. 5 but showing another embodiment of the invention.

FIGS. 1, 2, and 3 show a preferred embodiment of the invention in which a hopper type container indicated generally by the numeral 1 is comprised of a pair of vertical walls 2 and a pair of sloping walls 3 extending between the vertical walls 2 with both pairs of walls terminating in an outlet 4 at the bottom of the container. Each of the sloping walls 3 is covered by a wear resistant elastomeric cover sheet 5 which is preferably of flexible rubber and fabric construction such as conveyor belt material. The particular container shown in FIGS. 1 and 2 is a hopper having a horizonal grid 6 extending across the top of the container 1. The cover sheet 5 has its upper marginal edge clamped against the grid 6 between a clamping bars 7 and 7*a* extending across the length of the cover sheet edge and held in place by a series of bolts which pass through openings in the bars 7 and 7*a*, through the grid 6 and through a top clamping bar or plate 9 which rests on top of the grid 6. As may be seen in FIG. 2 the cover sheet 5 hangs downwardly along the inside surface of the sloping wall 3 and extends to a location near the outlet 4.

As shown in FIG. 2 a plurality of substantially U-shaped elastomer coated fabric slings 10 each have their upper marginal edge attached to the bottom side of the cover sheet 5 by suitable mechanical fasteners 11 passing through the sling members and the cover sheet. The location of the fasteners on each sling member 10 are shown in FIG. 3. A typical sling may have three fasteners at the top of the sling and one on each side of the sling to hold together the side marginal edges of the sling 10 upon inflation of the inflatable bag 12 which is supported loosely within the sling 10. The fasteners 11 on the sides of the slings 10 are spaced to permit the bag 12 to be slid into the end of the sling above the fasteners and lowered to the bottom of the sling. The inflatable bag 12 is made preferable of fabric material coated with an elastomeric material and sealed around its entire marginal edge except for a plurality of inflation deflation valves 13 located preferable in the lower corners of the bag. Each sling 10 is provided with a pair of holes 14 along its lower marginal edge to permit the valves 13 to extend through the sling 10 and to be attached to a manifold system as shown in FIG. 1. The valve arrangement in conjunction with the holes 14 positions the bag 12 in the sling 10. The valve location at the bottom of the bag allows moisture to drain out of the bags.

Alternate inflatable bags 12 are connected to the manifold 15. The remaining bags are connected to the manifold 16, solenoid valves 17 and 18 are connected respectively to the manifolds 15 and 16 for alternately introducing air to the inflatable bags 12 in the desired timed sequence. A high pressure air supply line 19 is connected between an air pump 25 and a pressure reducer 20 which in turn provides a specified air pressure to solenoid valves 17 and 18. The solenoids are cyclically energerized in timed sequence so that alternate bags are inflated through valve 13 while the other bags remain deflated or are simultaneously being deflated.

Various manual or automatic controls may be used to cyclically sequence the inflation and deflation of the bags. It should be understood that depending upon which bags are connected to which manifolds the pattern of inflation and deflation of the bags can be varied.

One of the valves 13 of each of the bags 12 is connected to one of the exhaust manifold lines 21 or 22 which in turn are sequentially closed or opened respectively by one of the controlled solenoid operated valves 23 or 24. The valves 17, 18, 23 and 24 are all connected to a programable timer 26 that controls the sequence of operations.

FIG. 2 shows in detail the action of the bags 12 beneath the cover 5 when the invention is in operation. The upper bag is shown in the deflated condition and the lower bag 12 is in the inflated condition thereby causing an outward bulge in the cover sheet 5 thereby creating an undulation of the cover sheet 5 which is suspended loosely with respect to the bags. It may be readily seen that when there is a series of bags such as those shown in FIG. 1 with alternate bags being continuously inflated and deflated that such bags bearing against the cover sheet will set up an undulating movement of the cover sheet which will create an unstable condition on the surface of the cover sheet 5 and the particulate moving over it and thereby maintain the constant flow of particulate material through the container 1.

The embodiment shown in FIGS. 4 and 5 is quite similar to that in FIGS. 1 through 3 except that the inflatable members instead of being inflatable fabric bags are inflatable elongated tubular members 12*a* such as flexible hose. The hose 12*a* are mounted in protective elongated fabric slings 10*a* or larger flexible hoses which are attached to the cover sheet 5 in the same manner as described in the previous embodiment in FIGS. 1 through 3. The hoses 12*a* shown in FIGS. 4 and 5 may also be positioned vertically rather than in the horizontal position shown. In such a case the hose 12*a* is clamped firmly at the top and bottom to the cover sheet but loosely within the sling to permit limited movement of the hose. For the purposes of simplicity similar parts in the embodiment shown in FIGS. 4 and 5 will be given similar numerals to like parts shown in FIGS. 1 through 3.

Since the operation of the embodiment shown in FIGS. 4 and 5 is substantially identical to that shown in the previous embodiment it will not be described in further detail.

FIG. 6 shows another embodiment which is similar to that shown in FIG. 5 except that the fabric sling 10*a* is attached to the container wall 3 by a row of bolts 11*a* along the upper edge of the sling. The sling 10*a* loosely supports the hose 12*a* between the cover sheet 5 and the wall 3 so that the hose 12*a* may move multi-directionally a limited distance with respect to the sheet 5 and the wall 3.

While for the purpose of illustrating the invention these two types of inflatable members and sling structures have been shown connected to the cover sheet, it may be understood that there are other various means for loosely supporting these inflatable members for multi-directional movement with respect to the cover sheet and the wall and for attaching the members in operative position within the container. It should also be understood that the cover sheet may be made of multiple overlapping pieces rather than a single piece and as an alternative the cover sheet may be attached to the container wall or other structural parts of the container rather than the grid 6 as shown in the drawings. These and various other modifications can be made herein without departing from the scope of the invention.

We claim:

1. An inflatable liner assembly for mounting on the interior surface of a container wall to assist in maintaining the flow of bulk particulate material from the container, said liner assembly comprising:

A. a plurality of inflatable members at space locations along said interior surface;

B. a flexible cover sheet loosely covering said members and said surface;

C. the cover sheet being attached along its upper edge to the container to suspend it within the container;

D. flexible sling means loosely supporting the inflatable members between the cover sheet and the container wall to permit limited multi-directional movement of the inflatable members with respect to the cover sheet and the adjacent container wall when the members are alternately inflated and deflated, each of the inflatable members lying loosely within the sling means in a substantially horizontal position and resting on the bottom of the sling means; and E. means supplying a fluid under pressure to the inflatable members.

2. The liner assembly of claim 1 wherein the flexible sling means supporting the inflatable members comprises a plurality of fabric slings each having its top marginal edges attached to the back side of the cover sheet so that each sling is suspended between the cover sheet and the interior surface of the container wall.

3. The liner assembly of claim 2 wherein the slings are of substantially U-shaped cross section and having at least one opening in the lower edge thereof to permit a valve from the inflatable member to extend therethrough for connection to a manifold.

4. The liner assembly of claim 2 wherein the inflatable member is a substantially rectangular fabric bag coated with elastomeric material.

5. The liner assembly of claim 2 wherein the inflatable member is an elongated flexible tubular member.

6. The liner assembly of claim 1 wherein the flexible sling means supporting the inflatable members comprises a plurality of fabric slings each having its top marginal edge attached to the container wall so that each sling is suspended between the cover sheet and the interior surface of the container wall.

7. The liner assembly of claim 1 wherein the means supplying fluid to the inflatable members is a manifold system connected between a fluid source and the inflatable members.

* * * * *